United States Patent [19]

Raburn et al.

[11] Patent Number: 5,007,124

[45] Date of Patent: Apr. 16, 1991

[54] SUPPORT PAD WITH UNIFORM PATTERNED SURFACE

[75] Inventors: Richard W. Raburn, Mauldin; Daniel J. Schaefer, Greenville, both of S.C.

[73] Assignee: Span-America Medical Systems, Inc., Greenville, S.C.

[21] Appl. No.: 267,202

[22] Filed: Nov. 4, 1988

[51] Int. Cl.[5] ..... A47C 27/14

[52] U.S. Cl. ..... 5/481; 5/468

[58] Field of Search ..... 5/481, 468, 469, 464, 5/448, 420; D6/606

[56] References Cited

U.S. PATENT DOCUMENTS

| | | | |
|---|---|---|---|
| 3,885,257 | 5/1975 | Rogers | 5/464 |
| 4,862,538 | 9/1989 | Spann et al. | 5/481 |

FOREIGN PATENT DOCUMENTS

| | | | |
|---|---|---|---|
| 0036158 | 3/1981 | European Pat. Off. . | |
| 2856758 | 12/1978 | Fed. Rep. of Germany | 5/481 |
| 2197785 | 11/1987 | Fed. Rep. of Germany . | |
| 1559851 | 5/1975 | United Kingdom | 5/481 |

*Primary Examiner*—Alexander Grosz

*Attorney, Agent, or Firm*—Dority & Manning

[57] ABSTRACT

A resilient pad has a uniform patterned patient support surface, including a plurality of parallel ribs. Each rib has a like profile of stacked compressive steps of varying widths. Progressive collapse of the steps under different loading results in differential resilient support responsive to such loading. Troughs between adjacent ribs have profiles identical to that of the ribs when inverted so that two pads may be simultaneously manufactured in mutually-facing, complementary alignment. Rib rocking action reduces the transmission of shear forces to a patient, while rib compression provides an air pumping action for circulating air about the patient.

12 Claims, 3 Drawing Sheets

Fig. 1.
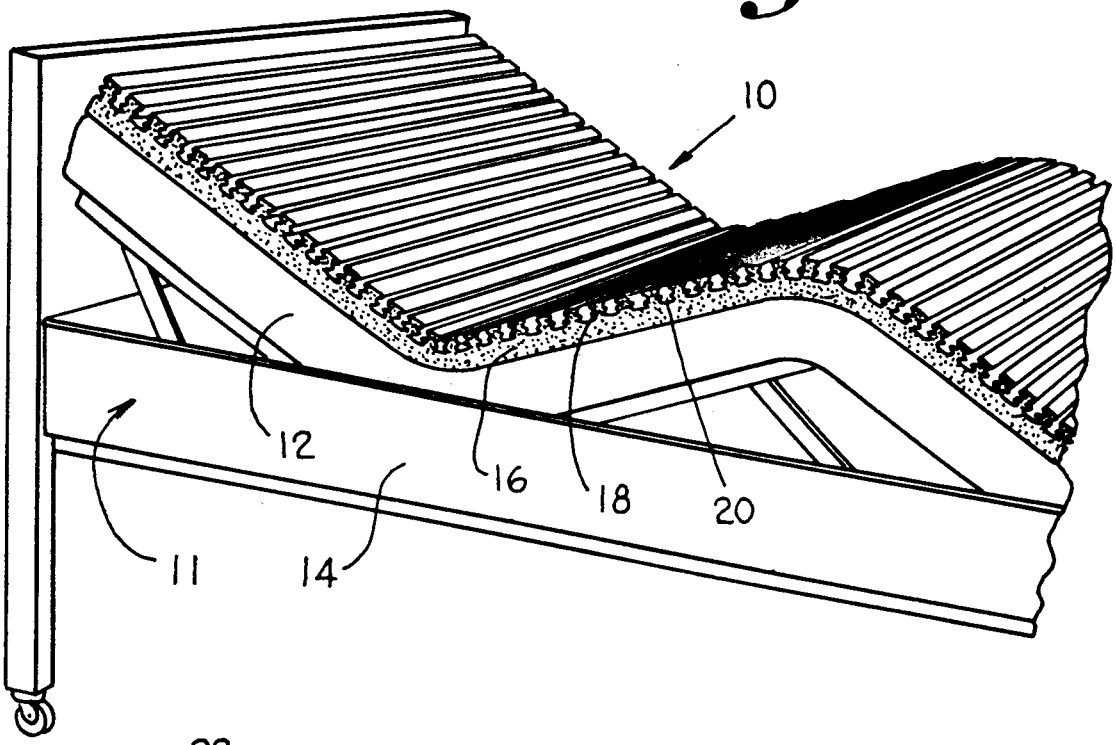
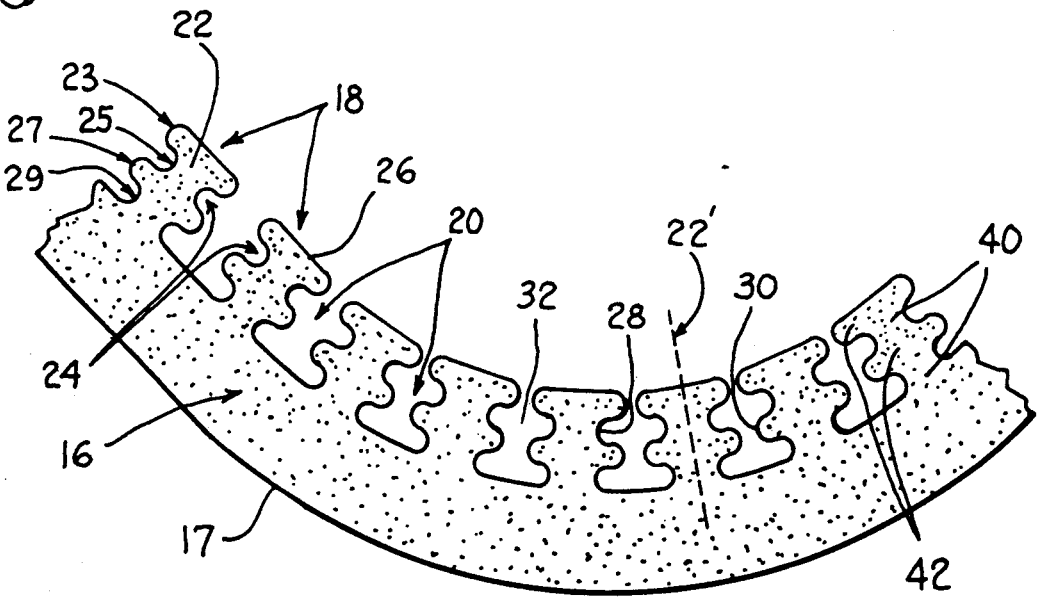
Fig. 2.

SUPPORT PAD WITH UNIFORM PATTERNED SURFACE

Benefit of earlier filing date is claimed based on U.S. Ser. No. 07/114,529, filed 10/28/87 now U.S. Pat. No. D307,687, and U.S. Ser. No. 07/129,089 filed 10/28/87 now U.S. Pat. No. D307,688.

BACKGROUND OF THE INVENTION

This invention relates to an improved support device, in general, and in particular a device such as a mattress pad for providing different degrees of support responsive to variable loading conditions, even with a uniform patterned support surface.

Numerous conventional support devices comprise a pad or the like formed of synthetic foam which elastically deforms to cushion a load received on the pad. For example, rectangular foam pads of uniform thickness have been used as mattress-like cushions for supporting the body of a person. Since some parts of the body (such as the chest or buttocks) are heavier than other, such parts compress the pad more than do the lighter extremities. Uniform thickness pads (having uniform support characteristics) are known for their tendency to exert uneven pressures on different parts of the body, especially resulting in relatively higher pressure on the heavier body portions. It is also generally known that certain levels of pressure exerted on a person's body by a support pad at the areas of contact therebetween, for given periods of time, tend to restrict proper blood circulation to those areas, which could lead to decubitus ulcers (bed sores).

In one typical approach to such problems, convoluted pads with dimpled surfaces are used to support a body. Such pads have numerous peaks which extend from the surface of the pad into contact with the patient to be supported. Each peak of a convoluted pad acts much like a separate cushion, thereby providing more variable support than a uniform rectangular resilient pad. While offering improved variable support over a uniform pad, the convoluted pad, too, may still tend to restrict circulation in the body at the points which are in contact with the peaks, again leading to decubitus ulcers.

Uniform thickness pads with slits cut into their support surface are also part of conventional efforts for providing improved patient support. Such slits in a pad create numerous sections which can act relatively independently to provide variable support. Use of a slitted pad having a flat contact surface may to some extent avoid the concentrations of pressure on a patient found adjacent to the peaks of a convoluted pad. However, variable or differential support adequate to prevent decubitus ulcers may still not be maintained. Also, with relatively narrow slits between adjacent sections, frictional engagement between such sections can interfere with fully independent operation of the sections. Such side-to-side frictional engagement of adjacent sections can also result in the transmission of shear forces to a patient received on such sections.

Furthermore, all of the above-mentioned pad types may tend to generally preclude adequate or desired ventilation of the underside of a patient which is in contact with the pad. Ventilation is necessary to aid in the healing of any wounds which may be present on the patient, and to generally improve the comfort of the patient by carrying away perspiration, thereby cooling the body.

The prior art contemplates numerous further surface features in efforts to improve patient support, such as holes through a pad or channels formed in a pad. In manufacturing such pads, various complicated cutting steps are often required, demanding skilled manual handling of the pad or sophisticated equipment, and producing a significant amount of waste material, which adds to manufacturing costs. Even greater manufacturing complexity is involved with some prior art pads which attempt to provide improved differential support of a patient by having multiple zones of different support surface features. See, for example, Rogers (U.S. Pat. No. 3,885,257) and Evans (Great Britain specification 1559851). The added complexity comes about from having to treat, cut, or otherwise process the pad differently to form each of its different zones.

SUMMARY OF THE INVENTION

The present invention recognizes and addresses such drawbacks and other aspects of support devices. Accordingly, it is one object of the present invention to provide a support device such as a pad which provides improved, differential support of a load thereon, but which can be efficiently manufactured with little or no waste material produced.

Another object of the present invention is to provide a resilient pad which affords well ventilated support to a user, while still offering a relatively flat or planar support surface for such user.

Still another object of the present invention is to provide a pad of foamed material which affords variable or differential support to different portions of the body of a patient, responsive to the weight of each such portion, and even while presenting a uniform patterned support surface (i.e., not having different zones with different support surface features or characteristics in each zone).

Another object is to provide an efficiently manufactured pad, which permits provision of a differentially-supportive yet uniformly-patterned support surface, while simultaneously producing two of such pads in a mutually-facing, complementary relationship. In other words, such improved pads may be preferably produced two at a time with interlaced, mirror images forming their respective uniformly-patterned support surfaces.

Another general object is to provide an improved support device for minimizing the transmission of shear forces to patients received thereon, even if the support device is used over curved or angled mattresses, such as on hospital beds which bend and fold for variously supporting patients. Another more particular object is substantial maintenance of the amount of patient support area while minimizing shear forces with such area.

Yet another object is to provide an improved support device for enhancing air flow around a patient received thereon, by providing an air pumping action generated by compression of the pad as a patient is initially received thereon or moves and repositions thereabout.

While the support device described herein is particularly adapted for use in connection with a mattress in institutional settings, such as in hospitals, it is to be understood that the pads described herein may be used in other settings, such as homes or convalescent centers, or for other purposes, such as insulating, cushioning, or any other more general packing usages.

Various present features may in different combinations form different constructions in accordance with this invention. One such exemplary construction includes a mattress pad, comprising: a generally rectangular base of resilient material, such base having a relative longitudinal axis, and a generally planar support surface on one side of such base adapted for resting on a mattress or the like; and a plurality of elongated members formed of resilient material, and integrally associated with the base on a second side thereof opposite the one side thereof, such elongated members being situated parallel to one another and generally perpendicular to the base longitudinal axis, with predetermined constant longitudinal spacing between adjacent such members so as to form a uniform support surface with the second side.

In the foregoing construction, preferably each of the elongated members have generally the same predetermined profile, viewed in a cross-sectional plane situated parallel to the base longitudinal axis and normal to the base second side, such profile having at least three distinct regions of different widths, whereby progressive collapse of such members responsive to a load received thereon results in varying resilient support characteristics presented to such load, such that in general relatively greater loads are provided relatively greater resilient support even though said pad has a uniform support surface on the second side thereof with the members all having generally the same predetermined profile and a predetermined constant spacing therebetween.

Another present exemplary embodiment is directed to a resilient supplemental patient support pad, comprising: a rectangular base of resilient material having first and second support surfaces on opposite sides thereof, such base having a relative longitudinal axis; a planar surface defined by the first surface; and a plurality of step-wise progressively collapsible resilient means for providing corresponding step-wise increasing resilient support therewith as respective collapsing action thereof progresses, such plurality of resilient means being integrally formed with the base on the second support surface thereof, and being substantially identical to one another for defining a patient support surface with a uniform repeating pattern thereover; wherein differential patient support is provided over the patient support surface without requiring differential formation of such plurality of resilient means in said patient support surface.

Still another exemplary construction concerns a resilient pad having a plurality of mutually parallel, upstanding ribs integrally formed with a base for defining a primary patient support surface, with a constant predetermined spacing between adjacent of the ribs defining troughs therebetween, wherein each of the ribs have the same predetermined symmetrical cross-section, and the troughs each have a shape corresponding to the symmetrical cross-section inverted, and further wherein the symmetrical shape defines a plurality of stepped resilient support regions, whereby different portions of the primary support surface may differentially support patients thereon by virtue of step-wise progressive rib compression in order from relatively smaller to relatively larger width regions of such ribs, with the plurality of ribs providing a uniform pattern on the patient support surface.

These and other objects, aspects and features of this invention are more particularly discussed and described in the remainder of the specification. Various modifications and alterations to features, elements, and constructions disclosed herewith may occur to those of ordinary skill in the art, and are intended to come within the spirit and scope of this invention by virtue of present reference thereto. Such modifications and variations may include, but are not limited to, the substitution of functionally equivalent structures and elements for those expressly disclosed, illustrated, or suggested herewith, as well as the interchange and/or reversal of various features and elements presently disclosed.

BRIEF DESCRIPTION OF THE DRAWINGS

A full and enabling disclosure of the present invention, including the best mode thereof, to one of ordinary skill in the art is set forth more particularly in the remainder of this specification, including reference to the accompanying figures, in which:

FIG. 2 illustrates an enlarged, side elevational view of a portion of an exemplary embodiment of the present invention such as illustrated in FIG. 1, showing in greater detail the construction of a primary support surface thereof;

Figure 3:
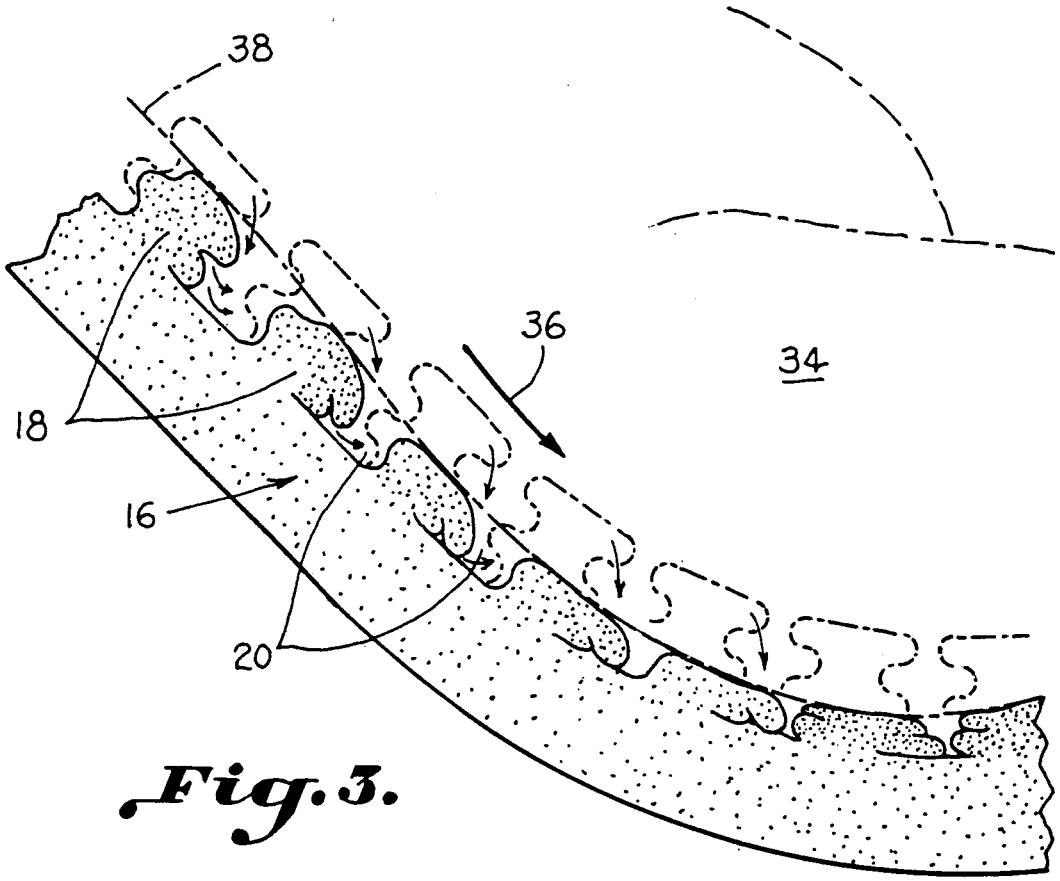
FIG. 3 illustrates an enlarged, side elevational view of an exemplary embodiment of the present invention such as illustrated in FIGS. 1 and 2, representing one example of pad deformation when supporting the body of a user thereon.

Repeat use of reference characters in the following specification and appended drawings is intended to represent the same or analogous features or elements of the present invention.

DETAILED DESCRIPTION OF THE PREFERRED EMBODIMENTS

Figure 1:
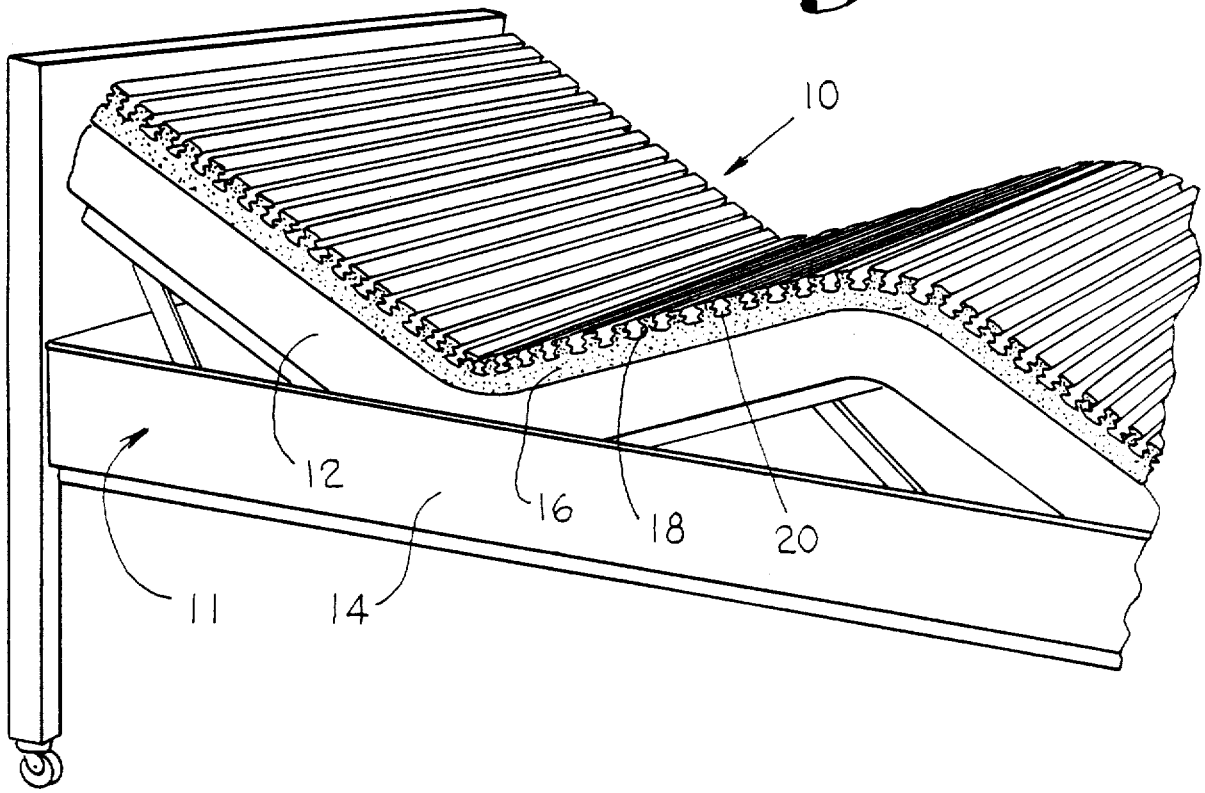
FIG. 1 illustrates a perspective view of an exemplary embodiment of the present invention, with the device placed upon a bed frame including an articulatable mattress such as typically used in a hospital setting.

The drawings illustrate a pad 10 of resilient material generally for use as a patient support device, and preferably in conjunction with a mattress 12 on a hospital bed 11, although use of pad 10 is not limited to such. Pad 10 is preferably formed of foam material flexible enough to be placed on mattress 12 of an articulatable bed frame 14, as shown in FIG. 1. Foam pad 10 comprises a base 16 and a plurality of preferably identical parallel ribs 18 spaced equidistantly and extending laterally across the base on one side thereof. As shown, for example, in FIG. 2, each pair of ribs 18 defines a trough 20 therebetween, while each rib 18 includes a predetermined cross-sectional profile 22 defined by two oppositely disposed lateral surfaces 24 and an upper contact surface 26 disposed substantially parallel to an opposite preferably planar side 17 of base 16. At least one of the lateral surfaces 24 defines a plurality of alternating transverse channels 28 and projections 30 as represented in FIG. 2. It is to be understood that both lateral surfaces 24 of a given rib may define such alternating channels 28 and projections 30.

Another manner of perceiving each rib 18 is as an elongated member of resilient material integrally associated with base 16 on one side thereof. The predetermined cross-sectional profile of such elongated members has a plurality of stepped regions, or distinct regions of different width, as exemplified by regions 23, 25, 27 and 29 (see FIG. 2). Such regions may also be considered as a stacked array of distinct steps or stepped regions. Progressive, step-wise collapse of such regions (beginning with the relatively narrow width regions), results in corresponding step-wise differential support of different loads on pad 10, and results in other present features, as more particularly discussed hereinafter. It is also desirable that each rib profile 22 be substantially symmetrical about a centerline 22' thereof (see FIG. 2). Preferably, each rib has at least three stepped regions. Four or more such regions may also be used in various alternative embodiments, such as the four region embodiments presently illustrated.

The preferred mutual spacing of ribs 18 on base 16, and of channels 28 and projections 30 thereon, ensures that each trough 20 defines a cross-sectional shape 32 identical to, but inverted from, the rib cross-sectional profile 22 (whenever the pad 10 is laid flat). The identical cross-sectional shapes 22 and 32 of ribs 18 and troughs 20, respectively, are important for manufacturing efficiency since cutting a unitary block of foamed material along the outline of ribs 18 and trough 20 would simultaneously create two identical pads 10. The "cut-away" portions would form the troughs in one pad while becoming the ribs of a complementary pad, and vice versa. Thus, after a single cutting pass, such as with a hot wire, wire blade, or the like, the result would be mutually facing pads with interlaced troughs and ribs, ready to be separated by pulling the two pads of resilient material apart. Manufacturing costs are reduced by virtue of the simultaneous production of two identical products and by the total elimination of wasted raw material.

Further according to this invention, use by a patient of a present pad is beneficial to the user in many ways. For example, the upper contact surface 26 (i.e., free, extended edge) of each upstanding rib 18 is substantially flat, thereby distributing the load supported by each rib 18 uniformly across a large area relative to the contact surface area of prior art convoluted pads. Such distribution considerably reduces much of the circulation restriction induced by the peaks of convoluted pads, and therefore contributes to the reduction of the incidence of decubitus ulcers. Even with pad 10 oriented in a curved fashion (as illustrated in FIGS. 1–3), to follow the articulations of a hospital-type bed, the upper contact surface 26 of each rib 18 forms a substantially smooth, slightly curved surface conforming to the body of a user, thereby providing comfortable load engagement while distributing such load across each rib 18.

In case patient 34 slides relative pad 10 (such as represented in FIG. 3 as movement in the direction of arrow 36), foam pad 10 should be flexible enough, and the ribs adequately separated, to allow ribs 18 to be deformed to such an extent that a substantially smooth contact surface 38 is obtained while minimum shear forces are transmitted to the shifting patient. Shear forces generally involve frictional engagement of the support surface with the patient as the patient shifts relative its support. By virtue of the "following" type movement of ribs 18 illustrated in FIG. 3, practice of the present invention helps minimize such shear forces, resulting in an improved patient support device particularly adapted for use with hospital-type beds 11 (see FIG. 1). Other present aspects of shear force reduction are discussed below with reference to FIG. 5.

Furthermore, each rib 18 reacts individually to any loading applied to pad 10, thereby providing variable support to the body of a user, whereby heavier portions of the body compress the ribs further than do lighter portions. Differing width regions 23, 25, 27, and 29 defined in the rib cross-sectional profile 22 allow ribs 18 to be compressed in discrete or step-wise stages responsive to increasing loading. There is, in effect, a step-change increase in load required to compress each successive stage of a given rib, to some extent resulting in a snap-action of such collapse.

Channels 28 in each rib 18 form alternately relatively narrow width portions 40 (e.g., regions 25 and 29) laterally adjacent to channels 28, and relatively larger width portions 42 (e.g., regions 23 and 27) disposed laterally adjacent to, and including, projections 30. In FIG. 2, ribs 18 are illustrated as including relatively rounded or curved portions 40 and 42. However, it is to be understood that the invention is not limited to such, and different structures of each (e.g., squared or angular) may be practiced without departing from the spirit and scope of this invention.

When sufficient load is applied to a rib 18 of the first embodiment of the present invention, the pad is deformed in multiple stages, as follows. When load is first applied to pad 10, the relatively narrow width portions 40 (regions 25 and 29) are compressed, effectively eliminating channels 28, such as by bringing the projections 30 into contact with each other, and by bring one of such projections into contact with base 16. Upon application of greater loading, the relatively larger width portions 42 (regions 23 and 27) are compressed until the upper contact surface 26 of such rib 18 is compressed to base 16. With still more loading, the base itself begins to deform or compress. In this way, different ribs 18 (or even different parts of the same rib or elongated member 18) variably deform to support portions of the body of a user. A corresponding step-change in resiliency, i.e., in resistance to compression, occurs as each successive compressive stage is reached since larger width regions of resilient material are progressively brought into play. With such an arrangement, relatively greater loading generally is differentially and automatically provided greater resilient support.

The foregoing aspects of the present invention are not limited to the specifically illustrated structures of FIGS. 1–3, which in various respects simultaneously embody certain asthetic elements in the illustrated design which subsist apart from, and form no part of, the present structural features and functions.

Figure 4:
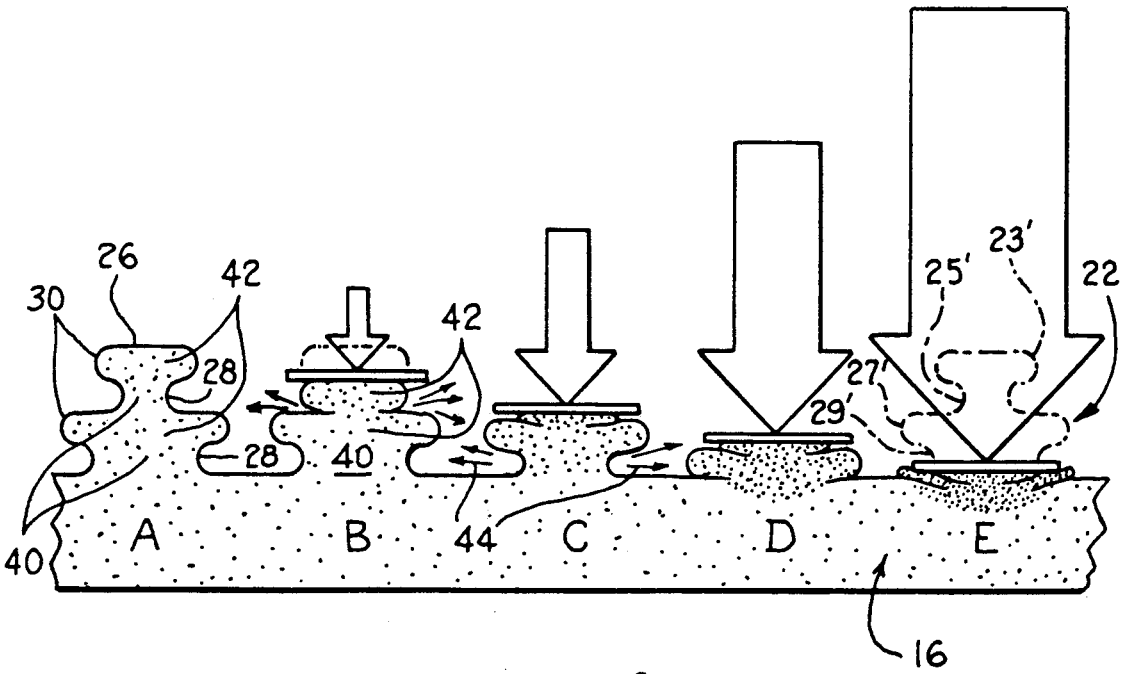
FIG. 4 illustrates an enlarged, side elevational view of a second exemplary embodiment of the present invention, showing a progressive collapsing feature of a present pad responsive to the application of differential loading thereto.

A second exemplary embodiment of the present invention is illustrated in FIG. 4, and provides an even greater number of compressive stages for more defined incremental or step-wise support. Due to changes in the relative widths of regions 23',25', 27', and 29' in accordance with the present invention, a given rib 18 of the second embodiment is compressed in five stages. As illustrated in FIG. 4, the rib profiles are symmetrical about their respective centerlines, and the troughs between adjacent ribs have shapes identical to the rib profiles when inverted. Increasing arrow sizes are intended to represent relatively increasing amounts of loading in FIG. 4.

The first illustrated stage of compression of the second embodiment of the present invention (as represented with rib B of FIG. 4) occurs upon compression of the relatively smallest width region 25'. The corresponding channels 28 are eliminated by such compression, and as the two projection portions 42 are brought into contact with somewhat of a snap-action upon such collapse, air is pumped outward as represented by the arrows emanating from between projections 42 of rib B.

The second stage of compression (as represented by rib C of FIG. 4) comprises the compression of the next smallest width region 23'. The third stage of compression (as illustrated by rib D of FIG. 4) continues with compression of the remaining least wide portion 29'. Since such third stage also involves elimination of a relative air channel (such as occurred in stage one, rib B) another air pumping operation occurs. For clarity in illustrating the relationship between such air flow and the air channel which collapses to form same, the air flow arrows 44 are themselves represented in connection with rib C, rather than rib D.

The fourth stage of compression (as illustrated by rib E of FIG. 4) comprises collapse of the largest width portion 27'. It is to be understood that a rib 18 including greater numbers of differing width regions would experience similar sequential, progressive stages of collapse until upper contact surface 26 were collapsed into base 16.

A fifth stage of compression (not shown in FIG. 4) involves compression of base 16 itself after full compression of rib 18. Of course, a given rib need not fully collapse if it only receives lesser degrees of loading, such as represented in conjunction with ribs B, C, and D. The second embodiment thereby provides variable or differential support in which each rib may be compressed in a plurality of step-wise stages. After a stage collapses, relatively greater width support strata is brought into play for increased support. Such differential support in conjunction with the flat upper contact surfaces 26 allows for improved blood circulation in the body of a user and reduces the incidence of decubitus ulcers, even with a pad having an efficiently manufactured uniformly patterned support surface.

As discussed, another beneficial feature of the present invention involves the improved ventilation afforded a patient. Troughs 20 generally allow air to circulate between ribs 18 to thereby ventilate the portion of a user which is in contact with or near foam pad 10. As illustrated in FIG. 3, even when ribs 18 are variously compressed, air may circulate beneath the user through the remaining portions of the troughs 20, which may become relatively reduced in size due to rib compression and/or deformation in the direction of arrow 36 (discussed above).

As has also been discussed, foam pad 10 of the present invention also provides a pumping action upon compression of the ribs 18, by which air is forced out of the rib channels 28 (e.g., as shown by small arrows 44 in FIG. 4) as the regions 25' and 29' are collapsed. While a patient reclines on a resilient pad formed in accordance with the present invention, the patient will likely from time-to-time move his or her body, thereby alternately compressing and decompressing (i.e., permitting expansion of) numerous ribs 18. As the ribs are compressed and decompressed, the corresponding channels described above will be likewise opened and closed, thereby forcing air to circulate beneath the patient. Such pumping action greatly improves air circulation beneath the patient to facilitate healing and improve comfort.

Figure 5:
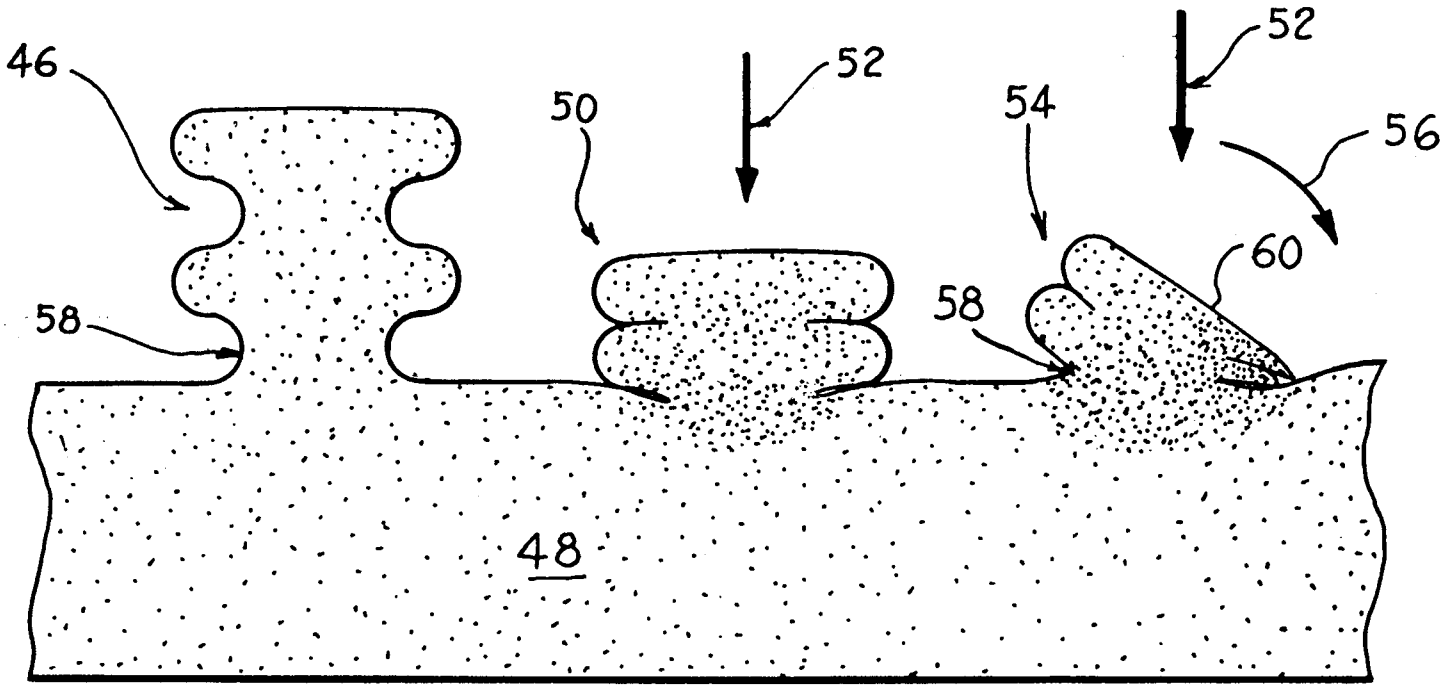
FIG. 5 illustrates in a further enlarged, side elevational view of the exemplary embodiments of FIGS. 1–3, a present feature for minimizing the application of shear forces to loads received on such pads.

FIG. 5 illustrates yet another feature of this invention which contributes to the minimization of shear forces being transmitted to a patient. The enlarged, side elevational view is representative of the first embodiment discussed above, but the illustrated feature hereof is equally applicable to other present embodiments. In particular, the rib 46 of pad 48 has generally no loading applied thereto. By comparison, rib 50 is partially compressed due to loading force 52 applied thereto. As represented, loading force 52 is substantially perpendicular (i.e., normal) to the upper surface of rib 50. Rib 54, by further comparison, is pivoted or rocked relative the alignment of ribs 46 or 50. Such rocking is due to a different, non-perpendicular component of loading force 56 acting on rib 54 in addition to force 52.

The advantage of the illustrated construction of FIG. 5 is that the relatively narrow width region 58 of the ribs provides for the represented rocking action (rib 54) so that upper surface 60 can follow a patient or load received thereon with diminution of its surface area. The significance of such form of "following" is again minimized shear forces, as discussed above in conjunction with FIG. 3. Though not illustrated, region 58 permits rocking of the ribs in either direction about the centerline thereof, and generally without limitation as far as the degree of compression of a given rib.

All of the foregoing structural features and functions of the present invention reside in the general inter-relationships of the illustrated structural members, not necessarily the specific illustrated interrelated lines and curvatures. Thus, the utilitarian features discussed herewith reside generally in the illustrated structures apart from the asthetic aspects of the specifically illustrated exemplary embodiments.

It will be understood by those of ordinary skill in the art that the foregoing specification and drawings discussed with reference thereto are only exemplary embodiments of the present invention, with all such language being by way of example only. Individual features and aspects of the foregoing exemplary embodiments may be varied for accommodating alternative applications, all without departing from the spirit of the present invention set forth in the appended claims.

What is claimed is:

1. A mattress pad, comprising:

a generally rectangular base of resilient material, said base having a relative longitudinal axis, and a generally planar support surface on one side of said base adapted for resting on a mattress or the like; and a plurality of elongated members formed of resilient material, and integrally associated with side base on a second side thereof opposite said one said thereof, said elongated members being situated parallel to one another and generally perpendicular to said base longitudinal axis, with predetermined constant longitudinal spacing between adjacent such members so as to form a uniform support surface with said second side;

wherein each of said elongated members have generally the same predetermined profile, viewed in a cross-sectional plane situated parallel to said base longitudinal axis and normal to said base second side, said profile having at least three distinct regions of different widths, whereby progressive collapse of said members responsive to a load received thereon results in varying resilient support characteristics presented to such load, so that relatively heavier loads are correspondingly provided relatively greater resilient support even though said pad has a uniform support surface on said second side thereof with said members all having predetermined constant spacing therebetween; and wherein said different width regions include at least one relatively smaller width region which is situated in said profile so as to have at least one relatively larger width region between itself and said base.

2. A mattress pad as in claim 1, wherein said different width regions include at least a second relatively smaller width region situated in said profile immediately adjacent to said base, to permit rocking action of a given elongated member about such second smaller width region, even after collapse of such given elongated member, whereby the transmission of frictional dragging forces to loads supported on such given elongated member is minimized.

3. A mattress pad as in claim 1, wherein said predetermined constant longitudinal spacing between adjacent elongated members is adequate to permit substantial deformation thereof along the longitudinal axis of said pad without frictional engagement between adjacent such members, whereby such freedom of movement of said members minimizes the transmission of shear forces to loads supported thereon.

4. A mattress pad as in claim 1, wherein said predetermined profiles are symmetrical about a centerline thereof, and said predetermined constant spacing defines troughs between adjacent elongated members, which troughs have a shape and size of said predetermined profiles when inverted.

5. A mattress pad as in claim 4, wherein:

said resilient material comprises a foamed man-made material; and said different width regions include at least one smaller width region which cooperates with an adjacent trough to form an air channel through which air is pumped outwardly therefrom as progressive collapse of its associated elongated member results in compression of such smaller width region.

6. A resilient supplemental patient support pad for use on a mattress, for providing differential support characteristics to a patient using a uniform patterned support surface, said pad comprising:

a rectangular base of resilient material having first and second support surfaces on opposite sides thereof, said base having a relative longitudinal axis;

a planar surface defined by said first surface; and a plurality of step-wise progressively collapsible resilient means for providing corresponding step-wise increasing resilient support therewith as respective collapsing action thereof progresses, said plurality of resilient means being integrally formed with said base on said second support surface thereof, and being substantially identical to one another for defining a patient support surface with a uniform repeating pattern thereover;

wherein differential patient support is provided over said patient support surface without requiring differential formation of said plurality of resilient means in said patient support surface; and further wherein said resilient means each comprise a respective rib situated perpendicularly to said base longitudinal axis, said plurality of ribs being spaced at respective predetermined intervals along said second support surface so as to define troughs between adjacent such ribs; and said ribs each comprise a stacked array of at least three distinct steps of differing widths, such array of at least three distinct steps of differing widths, such array being symmetrical about a perpendicular centerline thereof, and with two of said steps having relatively larger widths and being separated by the third step of relatively narrower width.

7. A patient support pad as in claim 6, wherein said predetermined intervals are established such that said troughs each define a profile corresponding to a rib symmetrical array when inverted.

8. A patient support pad as in claim 6, wherein said rib stacked arrays each include at least four distinct steps of differing widths, and wherein relatively lesser width steps are compressed by receipt of a given load to a rib before relatively larger width areas of such rib are compressed thereby.

9. A resilient pad having a plurality of mutually parallel, upstanding ribs integrally formed with a base for defining a primary patient support surface, with a constant predetermined spacing between adjacent of said ribs defining troughs therebetween, wherein each of said ribs have the same predetermined symmetrical cross-section, and said troughs each have a shape corresponding to said symmetrical cross-section inverted, and further wherein said symmetrical shape defines a plurality of stepped resilient support regions, whereby different portions of said primary support surface may differentially support patients thereon by virtue of stepwise progressive rib compression in order from relatively smaller to relatively larger width regions of said ribs, with said plurality of ribs providing a uniform pattern on said patient support surface, and wherein said symmetrical cross-section includes at least three stepped regions of differing widths such that no two adjacent regions in a given rib have the same width.

10. A resilient pad as in claim 9, wherein said symmetrical cross-section further includes a fourth stepped region, and wherein the region closest to said base provides a pivoting action for its associated rib relative said pad, to afford some movement relative said base for a patient supported on said patient support surface, with minimized shear forces transmitted to such patient.

11. A resilient pad as in claim 9, wherein said upstanding ribs are generally flat along the free upstanding edges thereof, so that a patient is received on a generally planar surface.

12. A resilient pad as in claim 9, wherein said base is generally rectangular and has a relative longitudinal axis, and said ribs are situated generally perpendicular to said base longitudinal axis and extend between opposing side edges of such base.

* * * * *

UNITED STATES PATENT AND TRADEMARK OFFICE

CERTIFICATE OF CORRECTION

PATENT NO. : 5,007,124

DATED : April 16, 1991

INVENTOR(S) : Richard W. Raburn, et al

It is certified that error appears in the above-identified patent and that said Letters Patent is hereby corrected as shown below:

Fig. 1 should be deleted and substitute therefor Fig. 1, as shown on the attached page.

Signed and Sealed this

Eighth Day of October, 1991

*Attest:*

*Attesting Officer*

HARRY F. MANBECK, JR.

*Commissioner of Patents and Trademarks*